US011476612B1

(12) United States Patent
Qiu et al.

(10) Patent No.: US 11,476,612 B1
(45) Date of Patent: Oct. 18, 2022

(54) POWER RECEPTACLE

(71) Applicant: Chengli Li, Suzhou (CN)

(72) Inventors: Shi Qiu, Suzhou (CN); Lei Qian, Suzhou (CN)

(73) Assignee: Chengli Li, Suzhou (CN)

( * ) Notice: Subject to any disclaimer, the term of this patent is extended or adjusted under 35 U.S.C. 154(b) by 0 days.

(21) Appl. No.: 17/390,313

(22) Filed: Jul. 30, 2021

(30) Foreign Application Priority Data

Jul. 15, 2021 (CN) ..... 202110798428.5
Jul. 15, 2021 (CN) ..... 202121603973.6

(51) Int. Cl.
*H01R 13/506* (2006.01)
*H01R 27/02* (2006.01)
*H01R 13/717* (2006.01)

(52) U.S. Cl.
CPC ..... *H01R 13/506* (2013.01); *H01R 13/717* (2013.01); *H01R 27/02* (2013.01)

(58) Field of Classification Search
CPC ..... H01R 13/506; H01R 27/02
See application file for complete search history.

(56) References Cited

U.S. PATENT DOCUMENTS 6,089,893 A * 7/2000 Yu ..... H01R 13/7177 439/225
9,941,642 B1 * 4/2018 Waggoner ..... H01R 13/66
10,074,948 B2 * 9/2018 Goyal ..... H01R 13/6675

FOREIGN PATENT DOCUMENTS

AU 2017203421 A1 * 12/2017

* cited by examiner

*Primary Examiner* — Briggitte R. Hammond
(74) *Attorney, Agent, or Firm* — Chen Yoshimura LLP

(57) ABSTRACT

A power receptacle includes an upper cover, a middle cover, and a base assembly. The middle cover includes an interface group, the interface group including at least one first-type interface, and at least one second-type interface and/or at least one third-type interface. The upper cover includes a matching interface group, the matching interface group including matching interfaces that match at least some of the corresponding interfaces of the interface group. The upper cover and the middle cover are removably attached to each other. Because the base assembly does not need to be changed while the upper cover may be changed based on the user's need, the power receptacle has enhanced applicability, saves cost and can meet user's different needs. Because the upper cover can be changed by the user without requiring a skilled worker, the power receptacle is easy to use.

20 Claims, 10 Drawing Sheets

POWER RECEPTACLE

BACKGROUND OF THE INVENTION

Field of the Invention

This invention relates to electrical devices, and in particular, it relates to a power receptacle.

Description of Related Art

In conventional power receptacles, because of the large variety of different products, the manufacturing of different products require different molds and production equipment. This results in high production cost and complex warehouse management. It also requires skilled workers, making it difficult to change from one model to another.

SUMMARY

To solve the above problems, the present invention provides a power receptacle, which includes an upper cover, a middle cover, and a base assembly. The middle cover includes an interface group, the interface group including at least one first-type interface, and at least one second-type interface and/or at least one third-type interface. The upper cover includes a matching interface group, the matching interface group including matching interfaces that match at least some of the corresponding interfaces of the interface group. The upper cover and the middle cover are removably attached to each other.

In some embodiments, a number of matching interfaces in the matching interface group on the upper cover is equal to or smaller than a number of interfaces in the interface group on the middle cover.

In some embodiments, any one of the at least one first-type interface, the at least one second-type interface and/or the at least one third-type interface is oriented parallel to a short side or a long side of the middle cover.

In some embodiments, the power receptacle further includes an illumination light. The illumination light can replace any one of the first-type interfaces, second-type interfaces, third-type interfaces or the matching interfaces.

In some embodiments, the at least one first-type interface includes at least one AC output interface.

In some embodiments, the at least one second-type interface includes at least one USB (Universal Serial Bus) Type-A or Type-B interface.

In some embodiments, the at least one third-type interface includes at least one USB (Universal Serial Bus) Type-C interface.

In some embodiments, the upper cover and the middle cover are attached to each other by snap connectors.

In some embodiments, the upper cover and the middle cover are slidably engaged with each other.

In some embodiments, the middle cover includes a step feature, and wherein the upper cover is attached to the step feature.

In some embodiments, the upper cover has one of a plurality of colors.

In the power receptacles according to embodiments of the present invention, the base assembly does not need to be changed, and the upper cover can be flexibly changed based on user's need, which enhances the applicability and versatility of the power receptacle and saves cost. Moreover, the upper cover can be replaced without requiring skilled workers, which manes convenient to use.

BRIEF DESCRIPTION OF THE DRAWINGS

Preferred embodiments of the present invention are described with reference to the drawings. These drawings serve to explain the embodiments and their operating principle, and only illustrate structures that are necessary to the understanding of the principles of the invention. These drawings are not necessarily to scale. In the drawings, like features are designated by like reference symbols.

DETAILED DESCRIPTION OF PREFERRED EMBODIMENTS

Preferred embodiments of the present invention are described below with reference to the drawings. These drawings and descriptions explain embodiments of the invention but do not limit the invention. The described embodiments are not all possible embodiments of the present invention. Other embodiments are possible without departing from the spirit and scope of the invention, and the structure and/or logic of the illustrated embodiments may be modified. Thus, it is intended that the scope of the invention is defined by the appended claims.

In the descriptions below, terms such as "including" are intended to be open-ended and mean "including without limitation", and can include other contents. "Based on" means "at least partly based on." "An embodiment" means "at least one embodiment." "Another embodiment" means "at least another embodiment," etc.

In the following descriptions, directional terms such as front, back, left, right, up, down, front end, back end, left end, right end, upper part, lower part, left side, right side, upper side, lower side, inner side, outer side, longitudinal direction, transverse direction, etc. are all relative to the orientation of FIG. 1.

Embodiments of the present invention provides a power receptacle, which includes an upper cover, a middle cover and a base assembly. The middle cover includes an interface group, the interface group including at least one first-type interface, and at least one second-type interface and/or at least one third-type interface. The upper cover includes a matching interface group, the matching interface group including matching interfaces that match the corresponding interfaces of the interface group. The upper cover and the middle cover are removably attached to each other.

The embodiments are described in more detail below with reference to the figures.

Figure 1A:
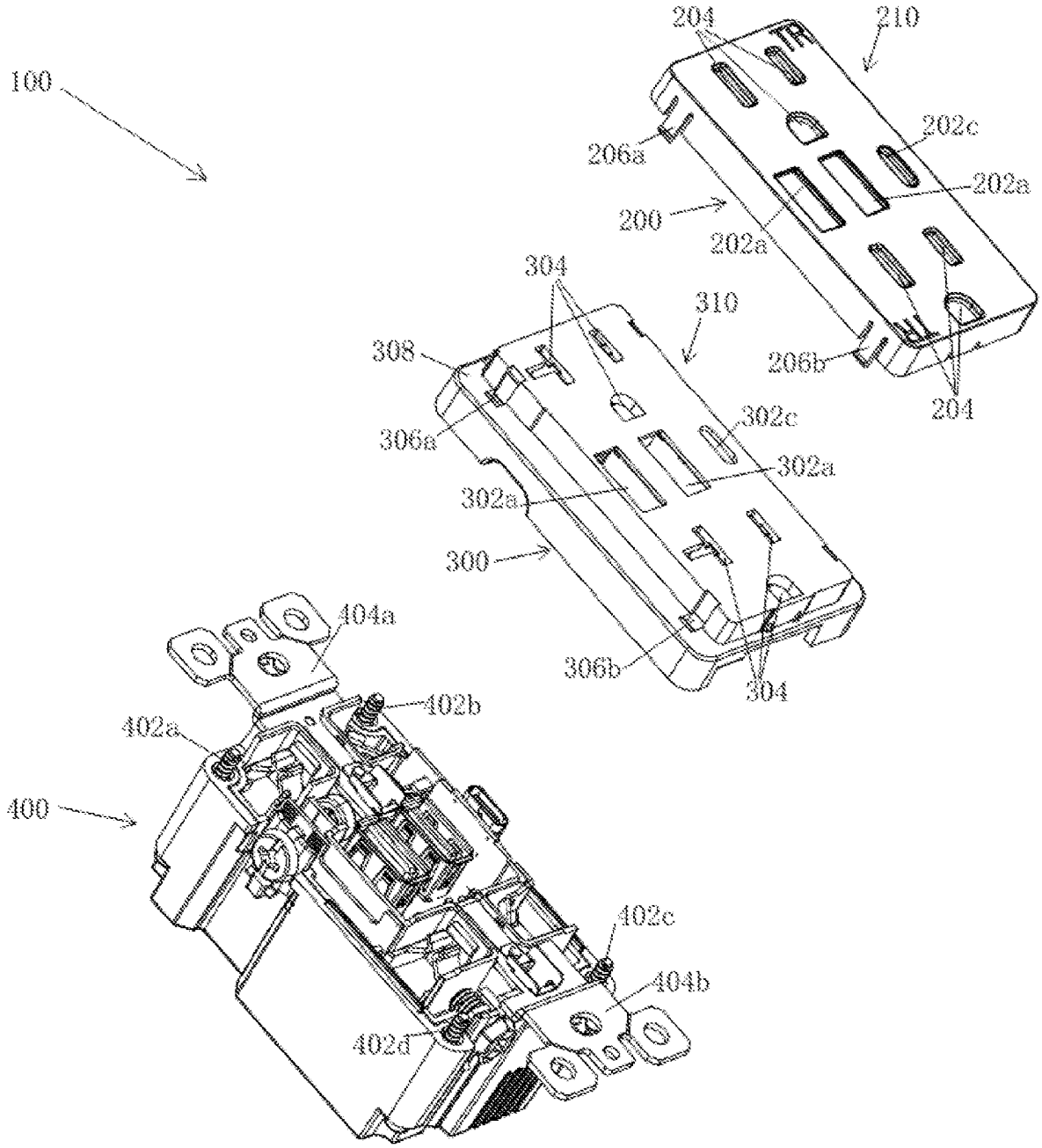
FIG. 1*a* is an exploded view of a power receptacle according to a first embodiment of the present invention.
Figure 1B:
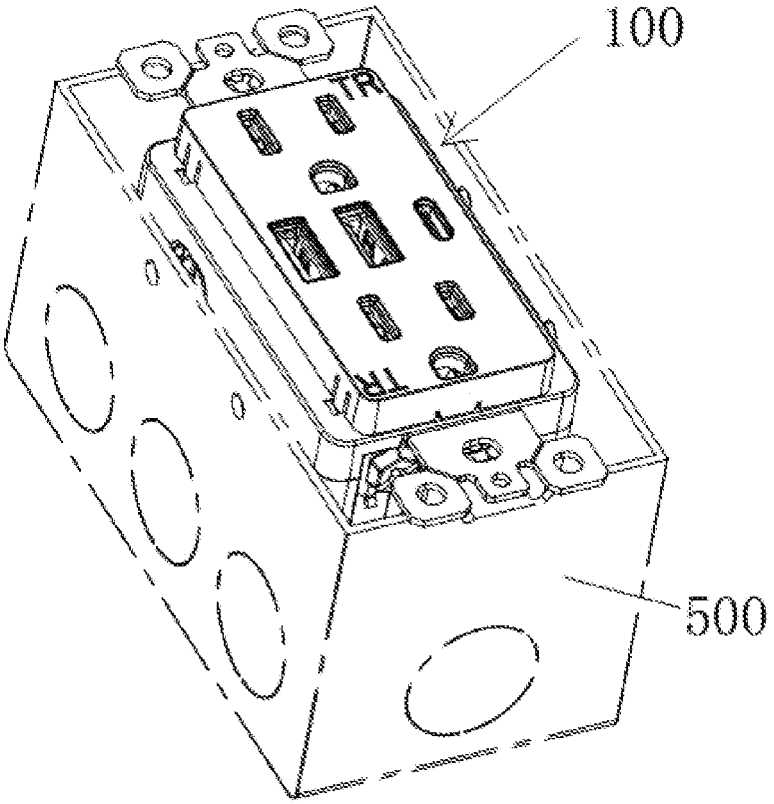
FIG. 1*b* illustrates the power receptacle of FIG. 1*a* that has been assembled and placed in an installation box.

In the embodiment shown in FIGS. 1*a*-1*b*, the power receptacle 100 includes an upper cover 200, a middle cover 300, and a base assembly 400. The middle cover 300 includes an interface group 310, which includes two first-type interfaces 304 (e.g., AC output interface, and more specifically, a standard AC output interface), two second-type interfaces 302*a* (e.g., USB (Universal Serial Bus) Type-A or Type-B interfaces) and one third-type interface 302*c* (e.g., USB Type-C interface). The upper cover 200 includes a matching interface group 210, which includes two matching interfaces 202*a* that match the two second-type interfaces 302*a* and one matching interface 202*c* that matches the one third-type interface 302*c*, as well as two matching interfaces 204 that match the two first-type interfaces 304. Each of the first, second, and third-type interfaces have electrical connectors that electrically connect to internal electrical components of the base assembly 400. Each of the matching interfaces preferably includes one or more through holes that match the shape of the interface being matched.

The middle cover 300 and the base assembly 400 are removably attached to each other. For example, as shown in FIG. 1*a*, the base assembly 400 is threadedly connected to the middle cover 300 by screws 402*a*, 402*b*, 402*c* and 402*d*. The upper cover 200 includes snaps 206*a* and 206*b*, which form a snap connector with the snap receivers 306*a* and 306*b* on the middle cover 300. The snaps 206*a* and 206*b* and the snap receivers 306*a* and 306*b* cooperate with each other to affix the upper cover 200 to the middle cover 300. The base assembly 400 includes grounding frames 404*a* and 404*b*, and the base assembly 400 is affixed to the receptacle receiving box 500 via the grounding frames 404*a* and 404*b*.

Still referring to FIG. 1*a*, the middle cover 300 has a step feature 308. In one embodiment, the step feature 308 has sliding slots, so that the upper cover 200 and the middle cover 300 are slidably engaged. It should be understood that the upper cover 200 and the middle cover 300 can alternatively be connected by other removeable connection mechanisms that facilitate easy replacement of parts.

Figure 2:
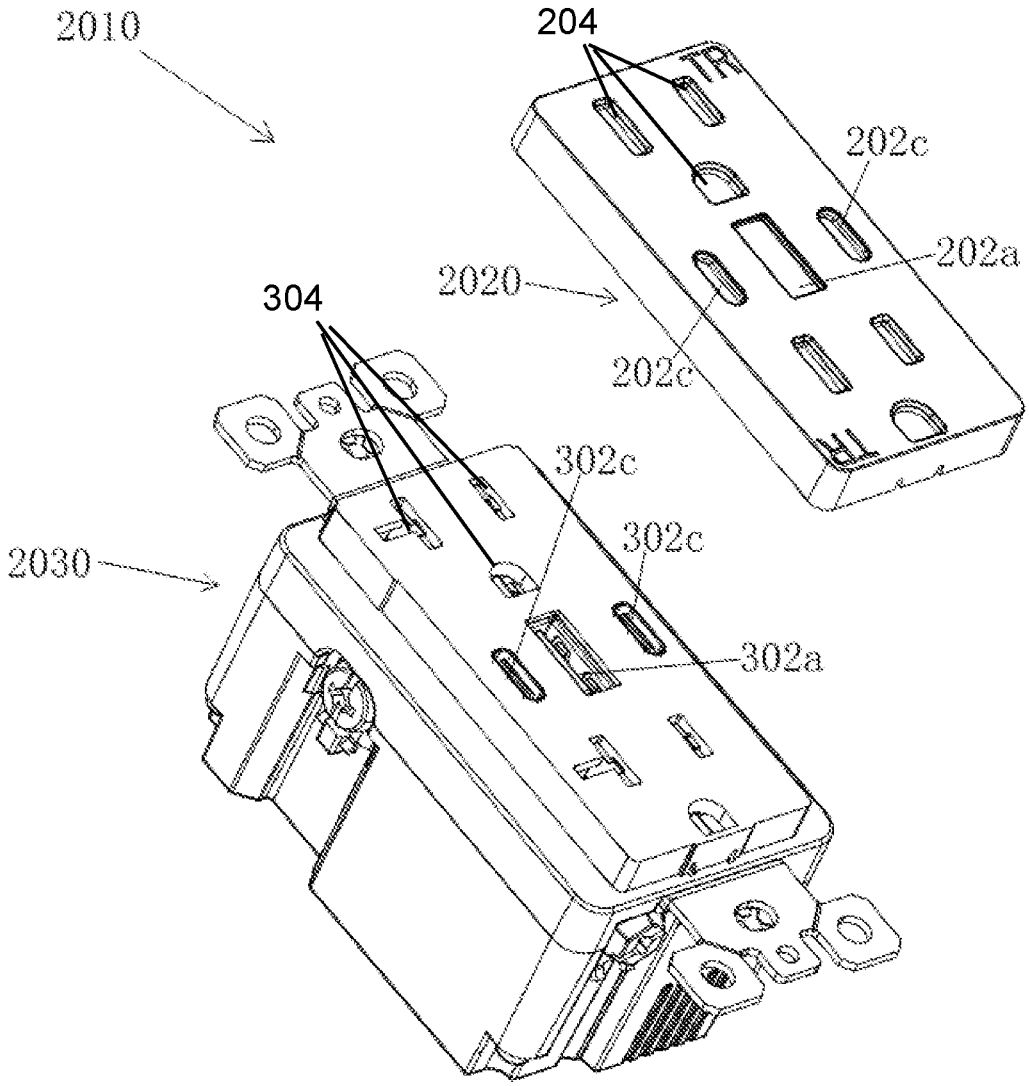
FIG. 2 is an exploded view of a power receptacle according to a second embodiment of the present invention.

In the second embodiment shown in FIG. 2, the overall structure of the power receptacle 2010 is similar to that of the power receptacle 100 of the first embodiment shown in FIGS. 1*a*-1*b*. One difference is that, the numbers of the second-type interfaces and third-type interfaces on the middle cover 2030 are different from those numbers on the middle cover 300. More specifically, the middle cover 2030 includes one second-type interface 302*a* and two third-type interfaces 302*c*. Correspondingly, the upper cover 2020 includes one matching interface 202*a* that matches the second-type interface and two matching interface 202*c* that match the two third-type interfaces.

Figure 3A:
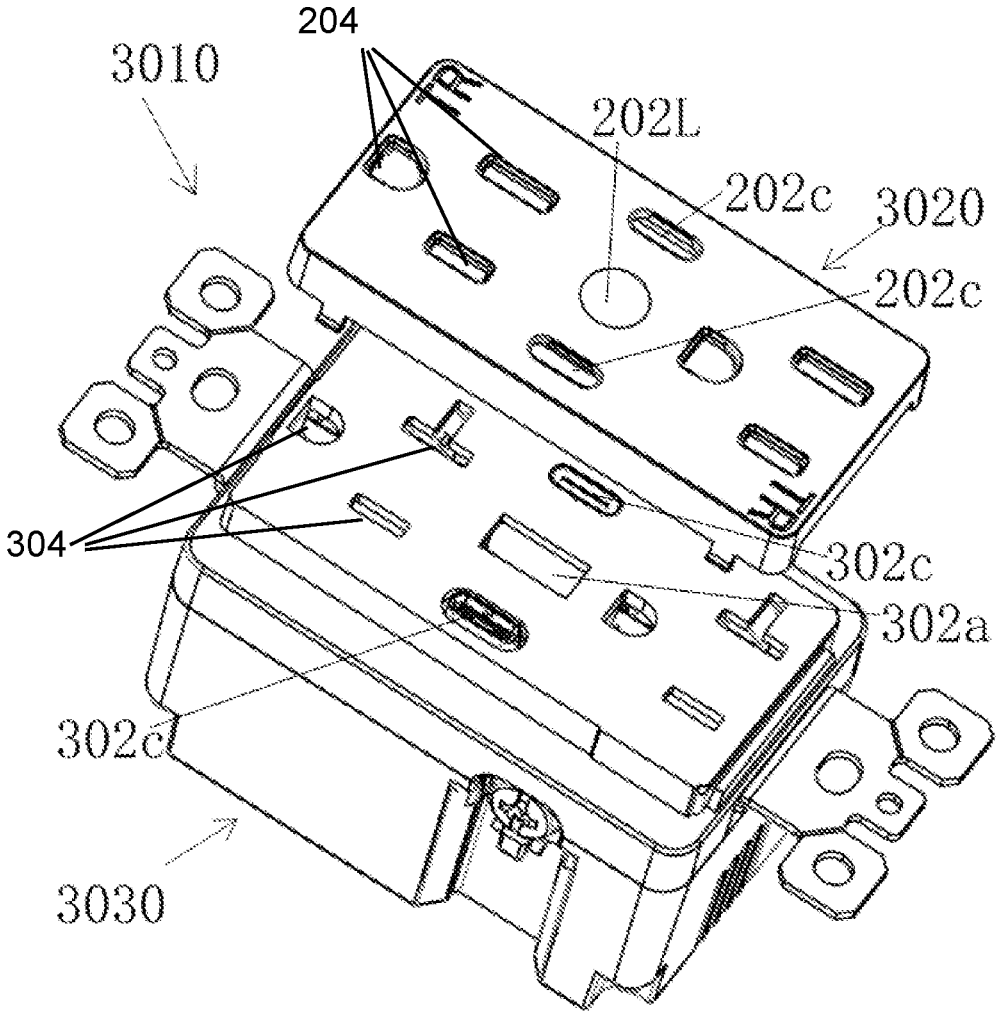
FIG. 3*a* is an exploded view of a power receptacle according to a third embodiment of the present invention.
Figure 3B:
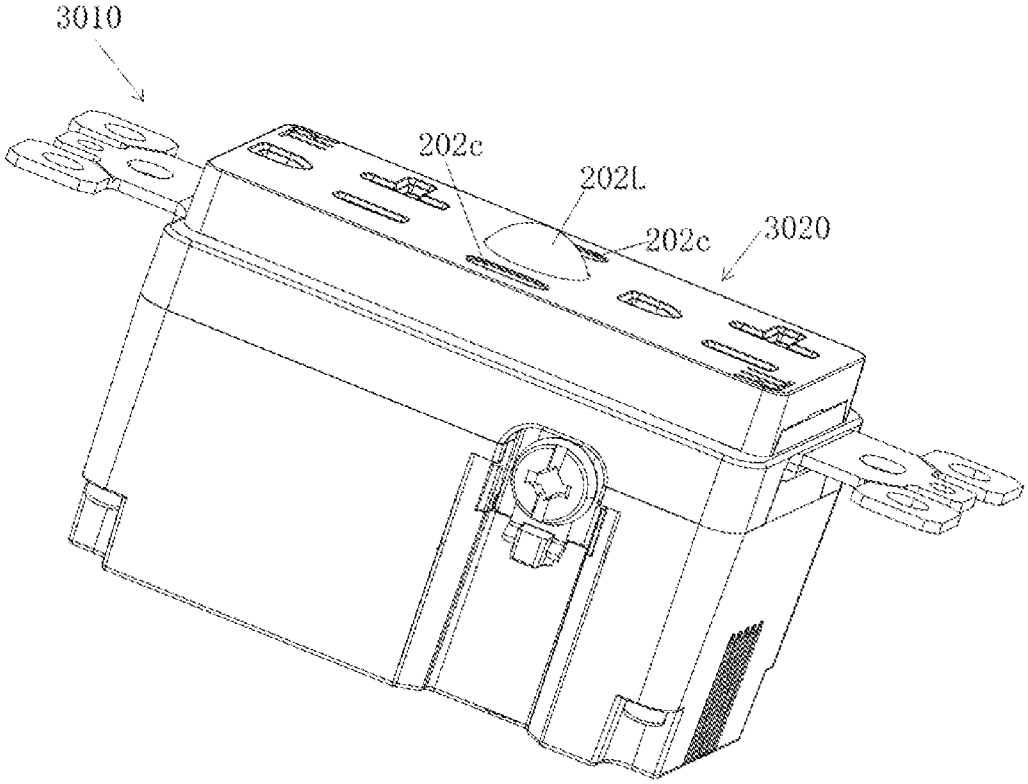
FIG. 3*b* illustrates the power receptacle of FIG. 3*a* that has been assembled.

In the third embodiment shown in FIGS. 3*a*-3*b*, the overall structure of the power receptacle 3010 is similar to that of the power receptacle 2010 of the second embodiment shown in FIG. 2. One difference is that, the upper cover 3020 includes an illumination light 202L (e.g., a small night light, for convenient illumination during the night) which replaces the matching interface 202*a* of FIG. 2 that matches the second-type interface 302*a*. The illumination light 202L may cover the second-type interface 302*a* on the middle cover 3030. In an alternative embodiment, the second-type interface 302*a* on the middle cover 3030 is changed to a third-type interface 302*c*, and the illumination light 202L cover the third-type interface 302*c*. In another alternative embodiment, the second-type interface 302*a* on the middle cover 3030 is changed to an illumination light 202L, and the interface configuration of the upper cover 3020 is the same as that of the upper cover 2020 in FIG. 2. In further alternative embodiments, the illumination light 202L may replace any interface besides the matching interface 202*a* of the upper cover 2020 and the second-type interface 302*a* on the middle cover 3030.

Although in FIG. 3*b* the illumination light 202L is shown as convex and protruding out of the top surface of the upper cover 3020, in alternative embodiments, the illumination light 202L may be flush with the top surface of the upper cover 3020 or slightly recessed from the top surface of the upper cover 3020. In another alternative embodiment, the upper cover 3020 has no illumination light; rather, at the location of the illumination light of FIG. 3*a*, a through hole or a transparent element is provided, so that the user can directly see the corresponding interface on the middle cover through the through hole or transparent element.

Figure 4:
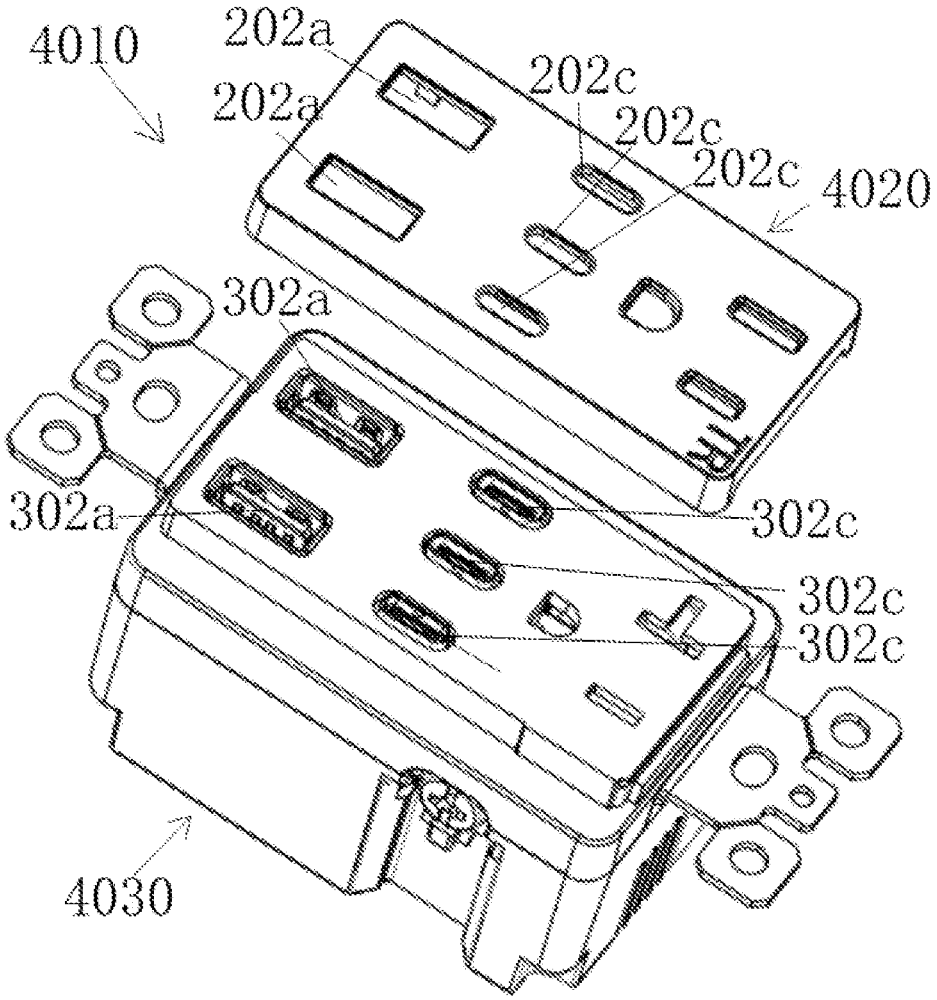
FIG. 4 is an exploded view of a power receptacle according to a fourth embodiment of the present invention.

In the fourth embodiment shown in FIG. 4, the overall structure of the power receptacle 4010 is similar to that of the power receptacle 3010 of the third embodiment shown in FIGS. 3*a*-3*b*. One difference is that, the second-type interface 302*a* in the middle cover 3030 is changed to a third-type interface 302*c* in the middle cover 4030, and one of the first-type interfaces 304 in the middle cover 3030 is changed to two second-type interfaces 302*a* in the middle cover 4030. In the upper cover 4020, the matching interface 204 in the upper cover 3020 which matches the first-type interface 304 in the middle cover 3030 is changed to two matching interfaces 202*a* in the upper cover 4020 that match the two second-type interfaces 302*a* in the middle cover 4030. Moreover, the illumination light 202L of the upper cover 3020 is changed to a matching interface 202*c* in the upper cover 4020.

Figure 5:
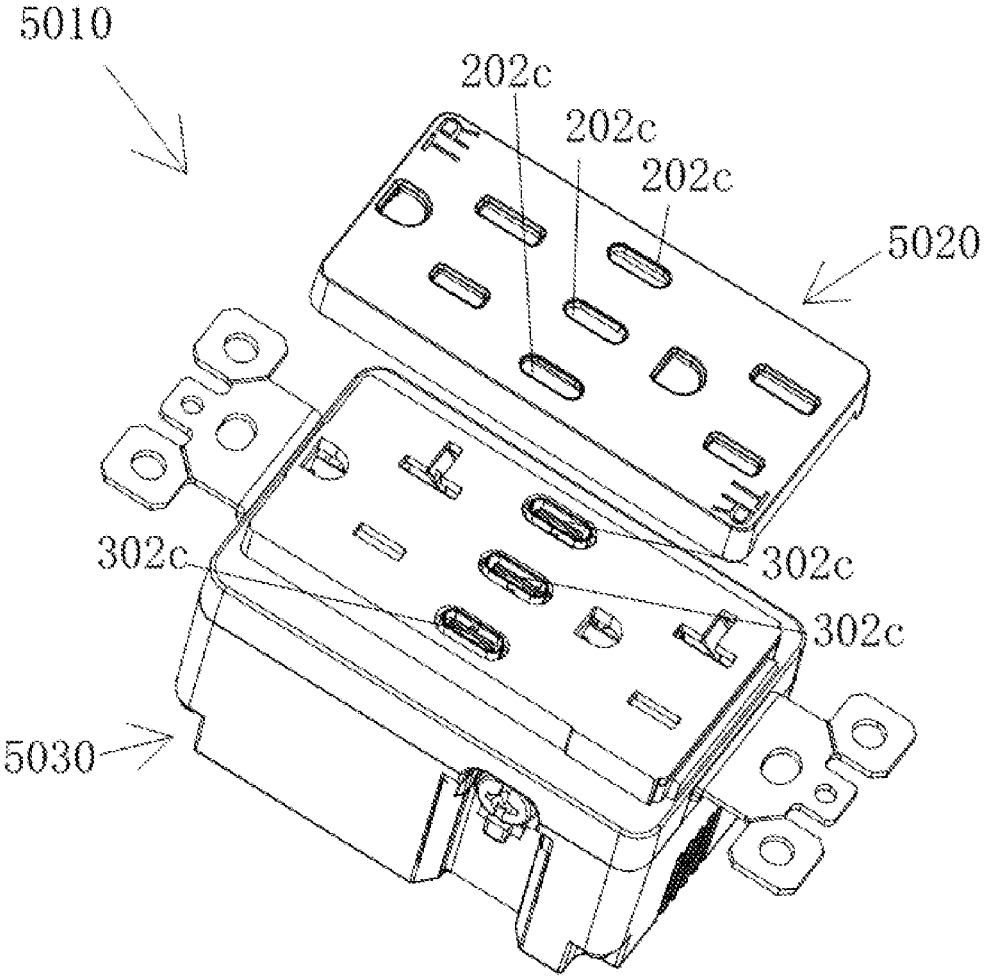
FIG. 5 is an exploded view of a power receptacle according to a fifth embodiment of the present invention.

In the fifth embodiment shown in FIG. 5, the overall structure of the power receptacle 5010 is similar to that of the power receptacle 3010 of the third embodiment shown in FIGS. 3*a*-3*b*. One difference is that, the second-type interface 302*a* in the middle cover 3030 is changed to a third-type interface 302*c* in the middle cover 5030, and the illumination light 202L in the upper cover 3020 is changed to a matching interface 202*c* in the upper cover 5020.

Figure 6:
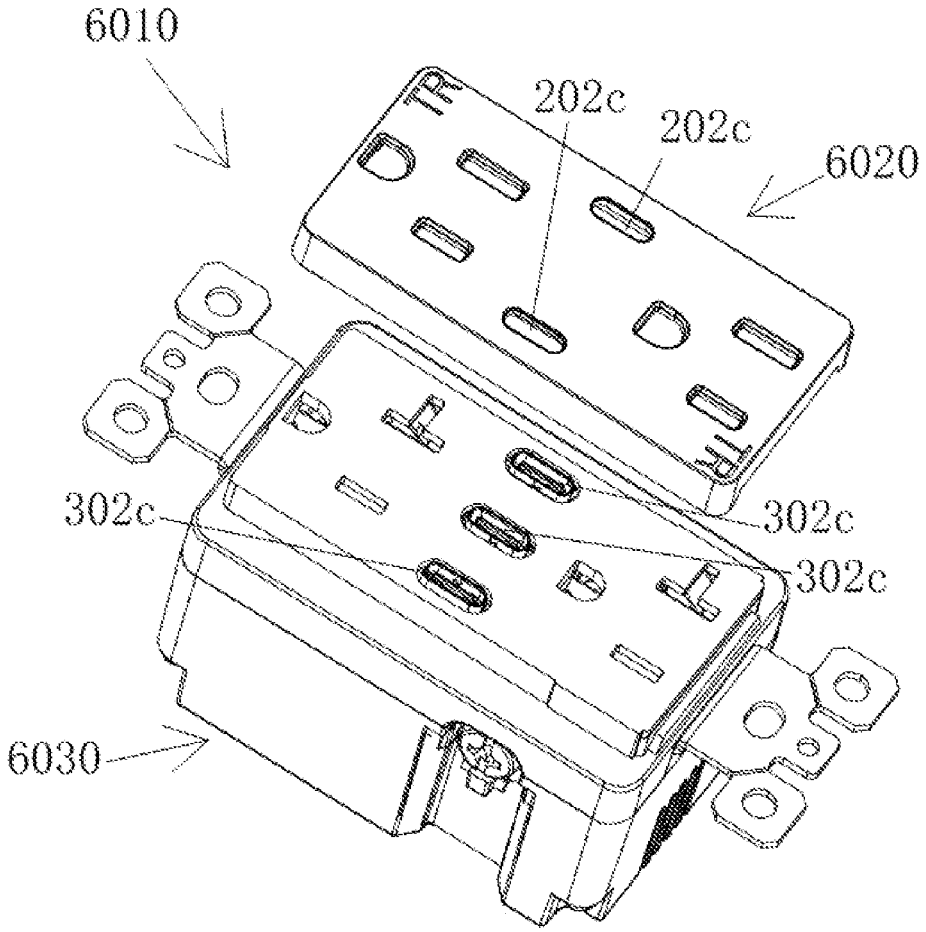
FIG. 6 is an exploded view of a power receptacle according to a sixth embodiment of the present invention.

In the sixth embodiment shown in FIG. 6, the overall structure of the power receptacle 6010 is similar to that of the power receptacle 5010 of the fifth embodiment shown in FIG. 5. One difference is that, the upper cover 6020 includes only two matching interfaces 202*c*; after the power receptacle 6010 is assembled, the third-type interface 302*c* located in the middle of the middle cover 6030 is covered by the upper cover 6020.

Figure 7:
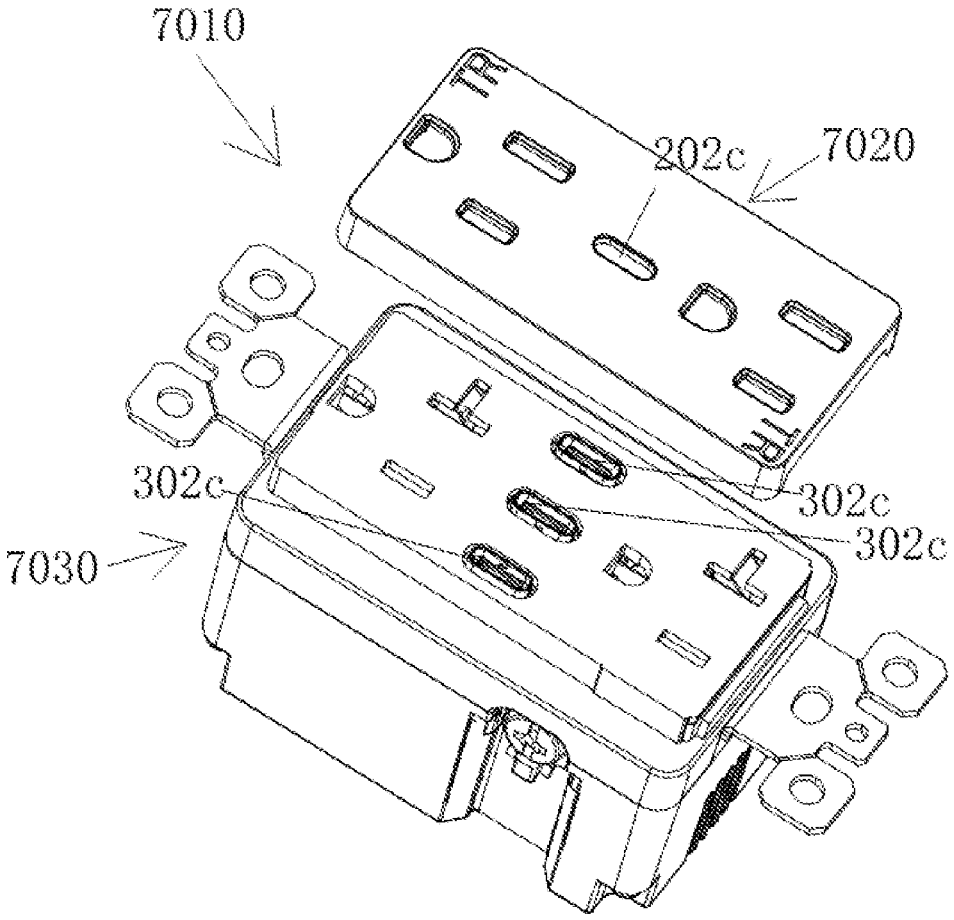
FIG. 7 is an exploded view of a power receptacle according to a seventh embodiment of the present invention.

In the seventh embodiment shown in FIG. 7, the overall structure of the power receptacle 7010 is similar to that of the power receptacle 6010 of the sixth embodiment shown in FIG. 6. One difference is that, the upper cover 7020 includes only one matching interface 202*c*; after the power receptacle 7010 is assembled, two of the three third-type interfaces 302*c* in the middle cover 7030 are covered by the upper cover 7020, leaving only one third-type interface 302*c* in the middle of the middle cover 7030 uncovered.

Figure 8:
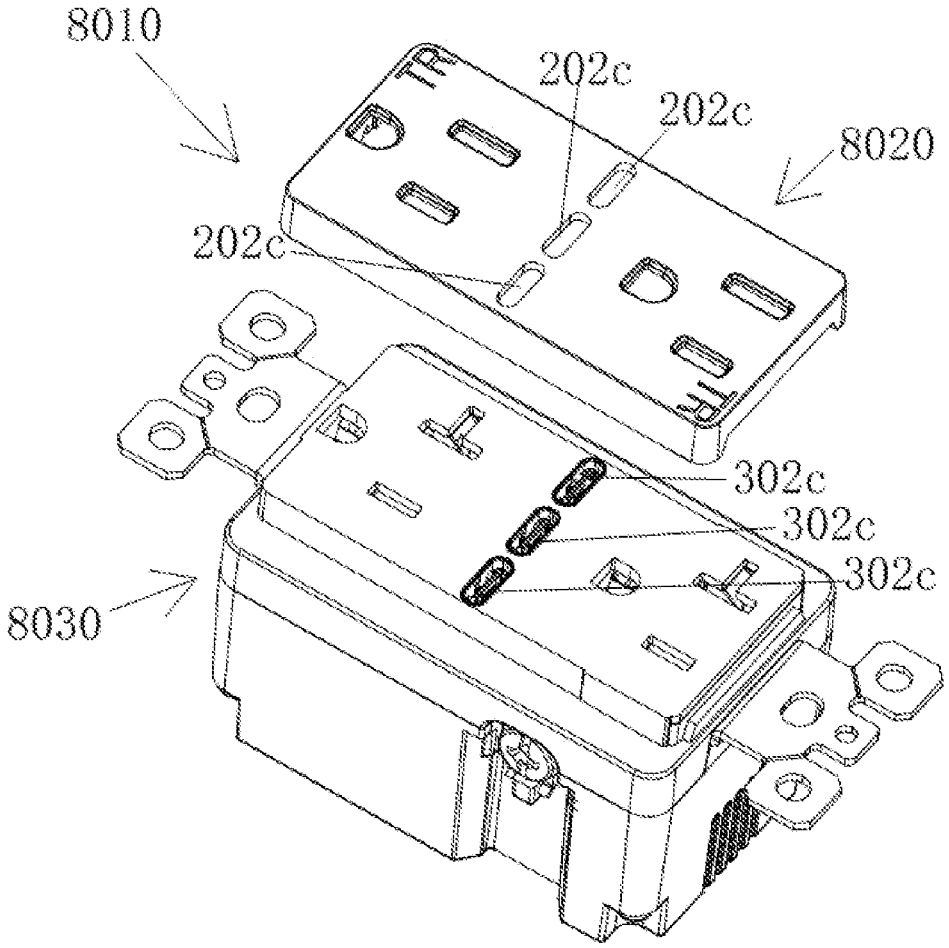
FIG. 8 is an exploded view of a power receptacle according to an eighth embodiment of the present invention.

In the eighth embodiment shown in FIG. 8, the overall structure of the power receptacle 8010 is similar to that of the power receptacle 5010 of the fifth embodiment shown in FIG. 5. One difference is that, the three third-type interfaces 302*c* on the middle cover 8030 are orientated parallel to the short sides of the middle cover 8030, while in the fifth embodiment they are oriented parallel to the long sides of the middle cover 5030.

It should be understood that in some embodiments, the interface group on the middle cover include two first-type interfaces and three second-type interfaces. In various embodiments, when space is available, the interface group on the middle cover may include any combination of multiple first-type interfaces, multiple second-type interfaces, and multiple third-type interfaces. In various embodiments, the spatial arrangements of the first, second, and third-type interfaces may be any suitable arrangements, not limited to the longitudinal and transverse arrangements shown in the drawings.

It should be understood that in some embodiments, the number of matching interfaces in the matching interface group on the upper cover is equal to or smaller than the number of interfaces in the interface group on the middle cover, so that the user may select a suitable upper cover and change to different upper covers based on their need. This enhances the applicability of the power receptacles.

It should be understood that in some embodiments, a matching interface that matches a third-type interface may be changed to an illumination light.

It should be understood that in some embodiments, the upper covers may have a variety of colors (e.g., red, yellow, blue, green, etc.) available for the user to choose from, so that the user may choose an upper cover of a desired color based on their need.

In the power receptacles according to embodiments of the present invention, because the base assembly does not need to be changed while the upper cover may be changed based on the user's need, the applicability of the power receptacles is enhanced. This achieves the goals of cost saving and meeting user demands. Moreover, because the upper cover may be changed by the user without requiring a skilled worker, the product is easy to use.

While the present invention is described above using specific examples, these examples are only illustrative and do not limit the scope of the invention. It will be apparent to those skilled in the art that various modifications, additions and deletions can be made to the power receptacles of the present invention without departing from the spirit or scope of the invention.

What is claimed is:

1. A power receptacle, comprising:

an upper cover;

a middle cover; and a base assembly;

wherein the middle cover includes an interface group, the interface group including at least one first-type interface, and at least one second-type interface and/or at least one third-type interface, wherein the upper cover includes a matching interface group, the matching interface group including matching interfaces that match at least some of the corresponding interfaces of the interface group, and wherein the upper cover and the middle cover are removably attached to each other;

wherein a number of matching interfaces in the matching interface group on the upper cover is smaller than a number of interfaces in the interface group on the middle cover, and at least one interface of the interface group of the middle cover is completely covered by the upper cover.

2. The power receptacle of claim 1, wherein any one of the at least one first-type interface, the at least one second-type interface and/or the at least one third-type interface is oriented parallel to a short side or a long side of the middle cover.

3. The power receptacle of claim 1, further comprising an illumination light, wherein the illumination light is located on the upper cover and matches one of the at least one first-type interface, the at least one second-type interface, and/or the at least one third-type interface.

4. The power receptacle of claim 1, wherein the at least one first-type interface includes at least one AC output interface.

5. The power receptacle of claim 1, wherein the at least one second-type interface includes at least one USB (Universal Serial Bus) Type-A or Type-B interface.

6. The power receptacle of claim 1, wherein the at least one third-type interface includes at least one USB (Universal Serial Bus) Type-C interface.

7. The power receptacle of claim 1, wherein the upper cover and the middle cover are attached to each other by snap connectors.

8. The power receptacle of claim 1, wherein the upper cover and the middle cover are slidably engaged with each other.

9. The power receptacle of claim 7, wherein the middle cover includes a step feature, and wherein the upper cover is attached to the step feature.

10. The power receptacle of claim 8, wherein the middle cover includes a step feature, and wherein the upper cover is attached to the step feature.

11. The power receptacle of claim 1, wherein the upper cover has one of a plurality of colors.

12. A power receptacle, comprising:

an upper cover;

a middle cover;

a base assembly; and an illumination light, wherein the middle cover includes an interface group, the interface group including at least one first-type interface, and at least one second-type interface and/or at least one third-type interface, wherein the upper cover includes a matching interface group, the matching interface group including matching interfaces that match at least some of the corresponding interfaces of the interface group, and wherein the upper cover and the middle cover are removably attached to each other, wherein the illumination light is located on the upper cover and matches one of the at least one first-type interface, the at least one second-type interface, and/or the at least one third-type interface.

13. The power receptacle of claim 12, wherein a number of matching interfaces in the matching interface group on the upper cover is equal to or smaller than a number of interfaces in the interface group on the middle cover.

14. The power receptacle of claim 12, wherein any one of the at least one first-type interface, the at least one second-type interface and/or the at least one third-type interface is oriented parallel to a short side or a long side of the middle cover.

15. The power receptacle of claim 12, wherein the at least one first-type interface includes at least one AC output interface.

16. The power receptacle of claim 12, wherein the at least one second-type interface includes at least one USB (Universal Serial Bus) Type-A or Type-B interface, and the at least one third-type interface includes at least one USB (Universal Serial Bus) Type-C interface.

17. The power receptacle of claim 12, wherein the upper cover and the middle cover are attached to each other by snap connectors.

18. The power receptacle of claim 12, wherein the upper cover and the middle cover are slidably engaged with each other.

19. The power receptacle of claim 17, wherein the middle cover includes a step feature, and wherein the upper cover is attached to the step feature.

20. The power receptacle of claim 18, wherein the middle cover includes a step feature, and wherein the upper cover is attached to the step feature.

* * * * *